US006026526A

United States Patent [19]

Payman

[11] Patent Number: 6,026,526

[45] Date of Patent: Feb. 22, 2000

[54] BIRTHING BED

[76] Inventor: Bahman Payman, P.O. Box 70, Medical Arts Building Suite 3, Pennington Gap, Va. 24277

[21] Appl. No.: 09/216,817

[22] Filed: Dec. 21, 1998

[51] Int. Cl.[7] ..... A61G 13/00

[52] U.S. Cl. ..... 5/602; 5/651; 128/845

[58] Field of Search ..... 5/602, 630, 632, 5/648, 651; 128/845; 601/45

[56] References Cited

U.S. PATENT DOCUMENTS 1,517,960 12/1924 Cuccia ..... 5/602

5,280,794 1/1994 Degen ..... 128/845

FOREIGN PATENT DOCUMENTS 2804268 8/1979 Germany ..... 5/602

*Primary Examiner*—Alexander Grosz

*Attorney, Agent, or Firm*—James W. Hiney

[57] ABSTRACT

A birthing bed for assisting a mother deliver a baby in a fashion so as to use more natural forces which consists of a tilted surface with a movable back support and a cord means which can be used by the mother to pull upward while pressing downward againist biased foot supports which are connected to the cord means.

11 Claims, 1 Drawing Sheet

BIRTHING BED

Figure 1:
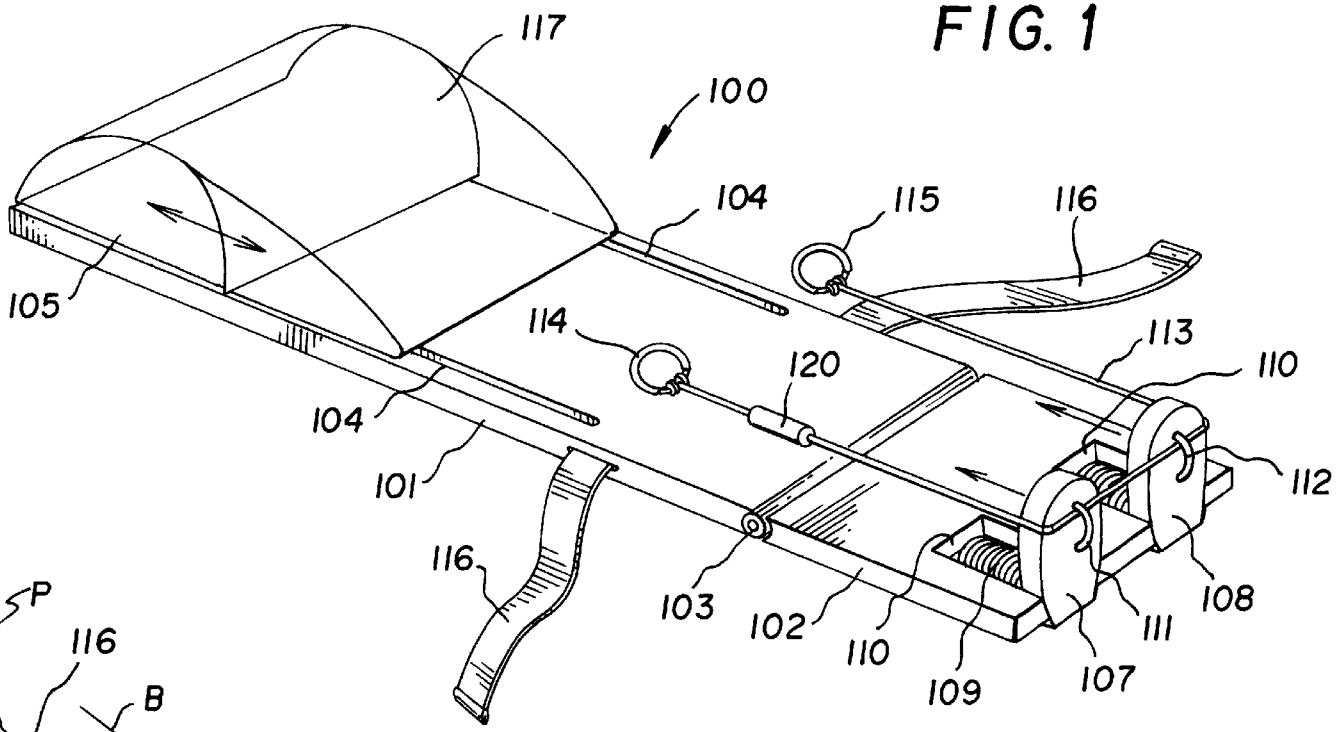

This invention relates to birthing beds especially designed to facilitate giving birth by women. The bed or attachment which is the subject matter of this invention is designed to maximize the women's own participation in the process and to utilize the natural process as much as possible by its orientation and configuration.

BACKGROUND

Since prehistoric times, women have assumed the standing, squatting or kneeling position in giving birth to their children. In the Archaeological Museum in Ankara, Turkey, is a specimen of a seated female figure believed to be the goddess of labor birthing in the squatting position. In ancient Egyptian paintings delivery of the goddess Ritho is shown in a kneeling position. Ancient Egyptian art shows women delivering in the kneeling position surrounded by helpers.

Hippocrates used a stool only for the delivery of a retained placenta. The Minoans were contemporaneous with the early dynasties of Egypt, and both used the obstetric stool. The Old Testament mentions delivery on a stone stool.

Standing and squatting positions clearly seem to have been the standard in ancient times. However, in the Indus Valley in India where obstetrics originated, women were delivered on beds. In early medieval times, and as early as 400 BC in Cyprus, women delivered on the laps of husbands or mothers, occasionally even strangers, until the obstetric chair came into common use.

The history of furniture design states that the chair evolved from the stool by the addition of a back and armrests. However, Meltzer tells the story of the invention of the chair by a carpenter who lived in Thuringen, Germany, and was removed for comforting women who sat on his lap during deliveries. The use of chairs in delivery continued until the early part of the 18th century when it was replaced by the couch. Avicenna hints that the position was prescribed to separate the pelvis at the symphysis pubis. The quote the description of Avicenna, "Stretch the legs without pity and then (shake her) while pressing skillfully on her abdomen. The Albuscasis position is virtually a closed symphysiotomy.

In the past, the Albuscasis position may have been the treatment for dystocia as they did have instruments to deliver dead fetuses. To find a modern labor position, it is pertinent to choose one that maximizes the pelvic widening that takes place during labor.

The Niam Naim deliver on a crude stool on the bank of a river with musical accompaniment. When labor is obstructed the women is suspended with a pulley-like device that elevates and lowers the body hoping to effect delivery by the force of gravity. Women have historically expressed dissatisfaction with the modern recumbent position and especially the recumbent-lithotomy variant. Some English women made complaints in Birmingham that resulted in research by Flynn et al who concluded that ambulation in labor should be adopted by Western physicians.

An analysis of labor positions of animals and of primitive societies, together with the sophisticated hemodynamic studies of the various labor positions, may lead to the discovery of more comfortable and mechanically advantageous positions for labor and delivery. In view of the serious drawbacks of recumbency and the numerable advantages of the ancient sitting positions, perhaps the time has come to say goodbye to the recumbent position.

Accordingly, it is an object of this invention to provide a bed or bed attachment which affords the most efficient delivery of children by a woman, and It is a further object of this invention to provide a bed or attachment which maximizes the natural processes of childbirth to afford a women the greatest ease in delivery, and Another object of this invention is to provide a system for child delivery which utilizes gravity and the input of the mother in providing for a more efficient delivery, and It is a still further object of this invention to provide a delivery bed or attachment which incorporates a slidable back rest, movable foot rests and a natural pulling attachment enabling the mother to bear down more efficiently.

These and other objects will become more apparent when reference is had to the accompanying drawing in which FIG. 1 is a perspective drawing of the instant invention showing an attachment which can be used as a bed or in conjunction with a bed.

Figure 2:
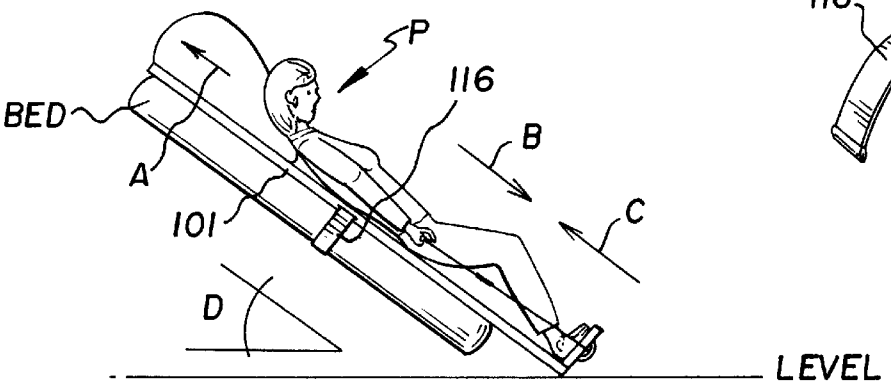

FIG. 2 is a vector analysis of the forces at work in the bed/attachment of this invention showing angle D which represents any given angle the bed happens to be in relative to the horizontal.

DESCRIPTION OF THE INVENTION

FIG. 1 shows the invention 100 which comprises section 101 which is hingedly connected as at 103 to section 102. A backrest 105 is slideably attached in section 101 by pegs or the like moving in slots 104. Backrest 105 can move up or down as the woman moves in relation to her pushing motion by her feet and by pulling up on the grips 114. Backrest 105 can have a disposable pad means (117) thereon. The lower portion of 100 has tow slots 110 cut therein which enable foot shaped members 107 and 108 to slidably move therein. The members are normally biased toward the bottom of the lower section 102 by springs such as 109. A cord member 113 is attached to grips 114 and 115 and passes through guides 111 and 112 on the bottom of the members 108 and 107.

As shown in FIG. 2 a patient P reclines on the device resting her back against the backrest and producing vector A when she pushes down with her feet also producing equal and opposite reaction vector C. By pulling on the cord against her thighs pressing downward a force vector B is produced. By pulling on the cord, a woman forces her feet to push on members 108 and 107 and bringing back rest forward thus adding to the natural gravity force caused by the fact that the invention is propped up and relies on gravity as well. By combining all these forces a woman is allowed to bring alot of forces naturally to bear to deliver the child. Pulling on the hand grips flexes the thighs and the back rest cuts down episiotomy rate considerably. It also prevents shoulder dystocia.

The back rest can be made of a disposable substance and construction which can be changes after each birth. Likewise, the invention may be covered by a pad or slip which can be changed after each delivery. The cord can be made adjustable as at 120 by providing for other sections to be added on. The foot members can be interchanged with larger or smaller members depending on the size of the women's feet. The hinging of the lower portion allows for it to swing out of line with the upper portion which assists in the women achieving the squatting position which is optimum for a lot of women.

The invention can be a bed itself or can be made to fit all existing hospital beds by being built in the configuration shown. The attachment lies upon an existing bed which is then modified so as to approach the vertical. The invention can be secured to the bed by straps 116 or by being bolted on. Various means of attachment can be used. The bed is thus very safe to use as it is used in the vertical or almost vertical position. The invention is good for pre-natal classes, demonstrations and birthing exercises.

Having described the invention it will be obvious to those of ordinary skill in the art that many changes and modifications can be made without departing from the scope of the appended claims.

I claim:

1. A birthing device to enable a woman to utilize more natural forces in delivering a child, said device comprising a first surface (101) designed to be oriented at an angle to the floor so as to take advantage of the force of gravity, a movable back support (105) on said first surface adapted to move lengthwise on said surface, foot support means (107,108) for engagement by a woman's feet to afford a downward thrusting movement, cord means (113) for engagement by a woman's hands whereby she may pull on said cord means to force her feet against said foot support means to supplement the force of gravity, said cord means being attached to said foot support means.

2. A birthing device as in claim 1 wherein said device is an attachment to go onto an existing hospital bed.

3. A birthing device as in claim 2 and including strap means (116) to secure the device to such a bed.

4. A birthing device as in claim 1 wherein said foot supports are movable and are biased (109) opposite from said first surface so as to offer resistance to upward pulling.

5. A birthing device as in claim 1 wherein said cord means (113) comprises an elongated cord slidably attached (111, 112) to said foot support means (107,108) and with hand grips (114,115) on the ends thereof for engagement by both of the woman's hands.

6. A birthing device as in claim 1 wherein a lower section (102) of said first surface is separate therefrom and hingedly connected thereto to allow for flexing of the woman's legs during downward thrust to allow for more directional and efficient thrusting.

7. A birthing device as in claim 6 wherein said foot support means comprise foot sections slidably biased by springs (109) against upward movement on said hinged section of the first surface.

8. A birthing device as in claim 7 wherein said cord means comprises an elongated cord (113) slidably attached to said foot support means (107,108) and with hand grips (114,115) on the ends thereof for engagement by both of the woman's hands.

9. A birthing device as in claim 8 wherein said back support means is padded and has pegs slidably engaged in slots (104,105) on said first surface to enable said support means to move in relation to a woman thrusting downward against the foot supports (107,108) while pulling upward on said cord means (113).

10. A birthing device as in claim 1 wherein said back support means has pegs slidably engaged in slots (104,105) in said first surface to facilitate said back support means moving in relation to said first surface to support a woman's back during the birthing process.

11. A birthing device as in claim 1 wherein said back support means has a disposable pad means (117) thereon for use with only one woman thereby maintaining sterile conditions.

* * * * *